United States Patent [19]

Grimes et al.

[11] 4,183,106

[45] Jan. 15, 1980

[54] SWIMMING POOL LIFT FOR THE HANDICAPPED

[75] Inventors: Gary E. Grimes, 572 Powderhorn Rd., King of Prussia, Pa. 19406; Gerald D. Brown, Landenberg, Pa.

[73] Assignee: Gary E. Grimes, King of Prussia, Pa.

[21] Appl. No.: 941,065

[22] Filed: Sep. 11, 1978

[51] Int. Cl.[2] ..... E04H 3/16; B66B 9/00; E04H 3/18

[52] U.S. Cl. ..... 4/172; 4/185 L; 4/134; 187/1 R; 297/DIG. 4; 5/81 R

[58] Field of Search ..... 4/172, 185 L, 172.19, 4/134, 145, 251, 172.18, 172.13, 185 S; 297/DIG. 4, DIG. 10; 187/1 R; 128/365, 369; 5/81 R, 83

[56] References Cited

U.S. PATENT DOCUMENTS

| | | | |
|---|---|---|---|
| 2,604,636 | 7/1952 | Nielsen | 4/185 L |
| 2,679,890 | 6/1954 | Zannoth | 4/185 L X |
| 2,779,949 | 2/1957 | Crispen | 4/185 L |
| 2,813,277 | 11/1957 | Zillt | 4/185 L |
| 3,371,357 | 3/1968 | Berthelsen | 5/83 |
| 3,381,317 | 5/1968 | Daniels et al. | 4/185 L |
| 3,815,163 | 6/1974 | Sullivan | 4/185 L |
| 3,829,916 | 8/1974 | James | 4/185 L |
| 3,918,108 | 11/1975 | Feyerherm | 4/185 L |
| 3,994,030 | 11/1976 | Cassell et al. | 4/185 L |
| 4,075,719 | 2/1978 | Sullivan | 4/185 L |
| 4,141,089 | 2/1979 | Krumbeck | 4/185 L |

*Primary Examiner*—Henry K. Artis
*Attorney, Agent, or Firm*—Frederick J. Olsson

[57] ABSTRACT

Apparatus supports a chair at the side of a pool in position to receive handicapped person. Chair is rotated out over the water and then lowered into the water where the occupant glides or pushes off for a swimming or therapy session. The chair is adapted to receive the person after the session and then is raised out of the water and rotated back to the poolside position so the person can leave the chair.

15 Claims, 10 Drawing Figures

Fig. 9
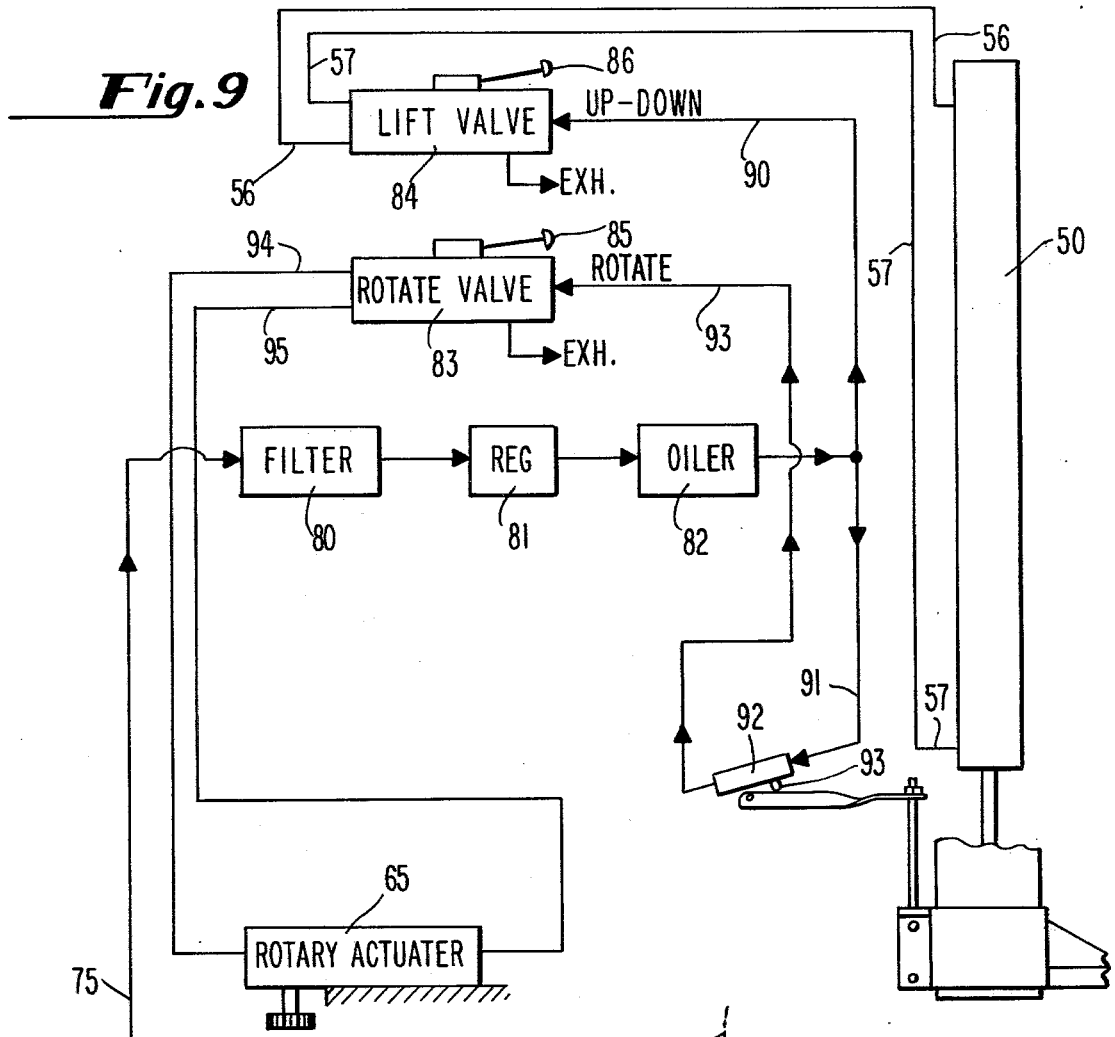
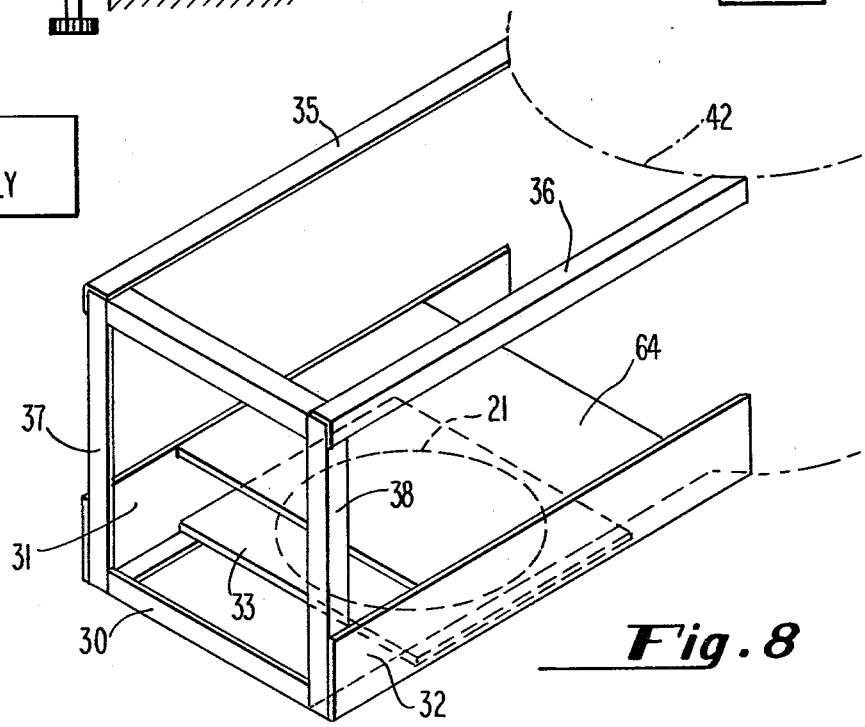
Fig. 8

SWIMMING POOL LIFT FOR THE HANDICAPPED

This invention relates in general to equipment used by handicapped persons.

More specifically, the invention relates to equipment which allows a handicapped person easy entry and exit from a swimming pool for recreation and/or therapy purposes.

The invention contemplates a chair on which a handicapped person on supportive equipment such as a wheel chair or crutches can, in most cases, enter the chair unassisted. When the person is properly positioned, the chair can be moved out over the water and down into the water and the person can easily push or glide off. At the end of a swimming or therapy session the person goes to the chair, gets in position, whereupon the chair is moved up and out of the water and back to the poolside surface where the person can return to his supportive equipment.

One object of the invention is to provide safe and efficient apparatus for getting a handicapped person in and out of a swimming or therapy pool.

Another object of the invention is to provide apparatus of the kind in question having chair means positionable at the side of the pool and arranged so that a handicapped person in a wheel chair or on crutches is able to enter and exit from a chair virtually unassisted.

Another object of the invention is to provide apparatus of the kind in question having chair means submersible in the water with a handicapped person seated therein and arranged so that the person can easily exit from the chair without assistance.

Another object of the invention is to provide apparatus of the kind in question having chair means submersible in water and arranged so that a handicapped person in the water can easily and unassisted enter in the chair and then be moved up and out of the water back to pool side for discharge.

Another object of the invention is to provide apparatus of the kind in question having chair means movable vertically and in and out of the water without lateral motion so as to avoid the person striking against the side of the pool.

Another object of the invention is to provide apparatus of the kind in question having chair means positionable at the side of a pool firm against the pool side surface for entry and exit of a handicapped person and having safety means providing that in such position the chair means can not be rotated and thereby avoid possible injury to a person entering or leaving the chair.

An embodiment of the invention will be described below in conjunction with the following drawings wherein.

FIG. 8 is a perspective view of certain of the framing of the equipment of FIG. 4;

FIG. 9 is a diagramatic view of the control system for use with the equipment of FIG. 1.

Figure 1A:
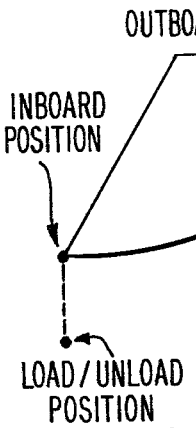
FIG. 1A is a diagrammatic view illustrating various positions and motions of the apparatus of FIG. 1.
Figure 1:
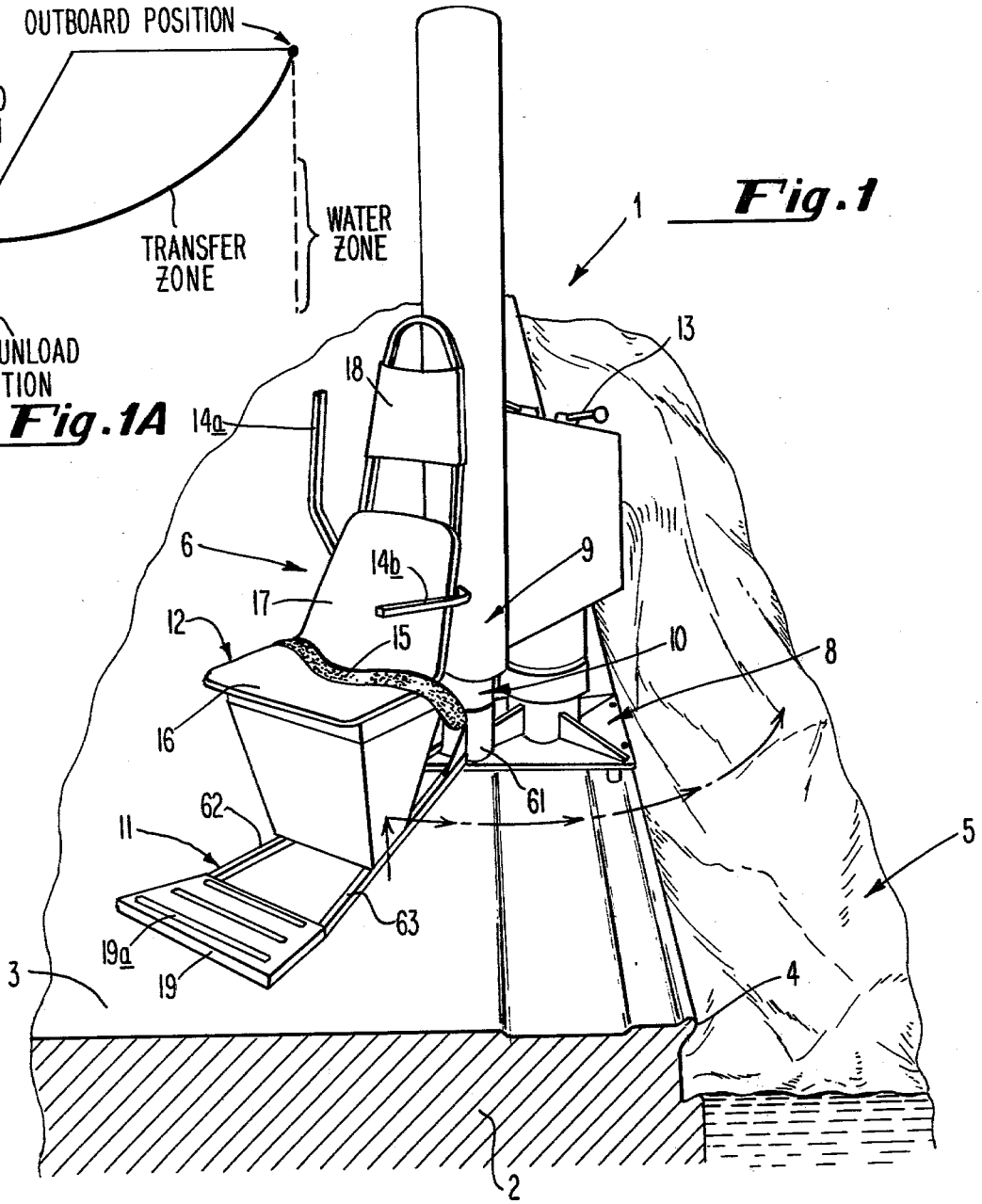
FIG. 1 is a perspective view of the apparatus of the invention resting on the pool side surface with the chair in ready condition for a handicapped person to enter or leave.

In FIG. 1 a swimming pool 1 has a side 2 with poolside surface 3 and edge 4. The water in the pool is indicated at 5. The apparatus 6 of the invention is shown disposed on the poolside surface 3 adjacent the edge 4.

The apparatus includes the base 8 fixed to the side 2, a frame means 9 adapted to rotate on the base in a generally horizontal transfer zone, a lift means 10 mounted on the frame for vertical reciprocating motion. A chair frame 11 is connected to the lower end of the lift means 10 and a chair means 12 is disposed on the frame 11. A control panel 13 has control members for operating the apparatus.

The position of the chair means 12 for the handicapped person to enter and leave the chair and to be put in and taken out of the water will be described below in connection with FIGS. 1, 2 and 3 and FIG. 1A which is a diagramatic view illustrating positions.

In FIG. 1 the chair means 12 is shown in the load/unload position with the chair frame 11 firmly down on surface 3 In this position the frame 11 and chair means 12 can not be rotated as will be explained later.

Figure 2:
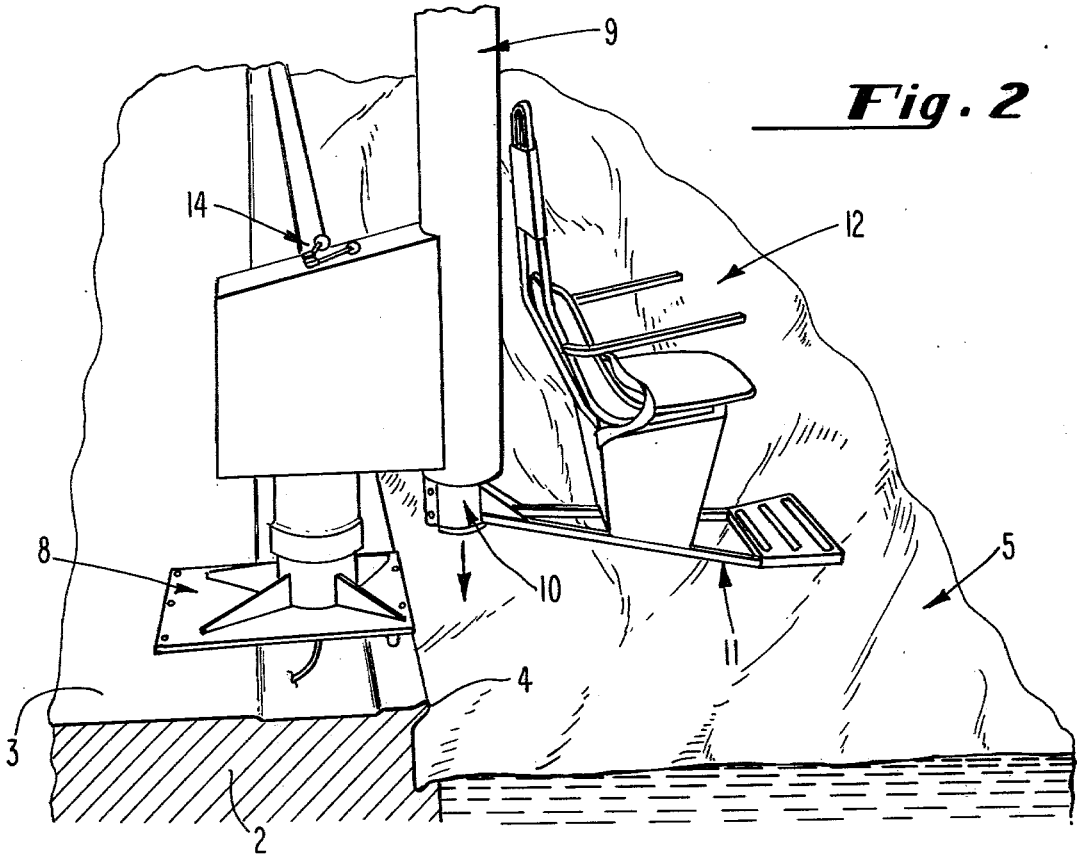
FIG. 2 is a perspective view of the apparatus of FIG. 1 rotated so that the chair is in position to be lowered into the water.
Figure 3:
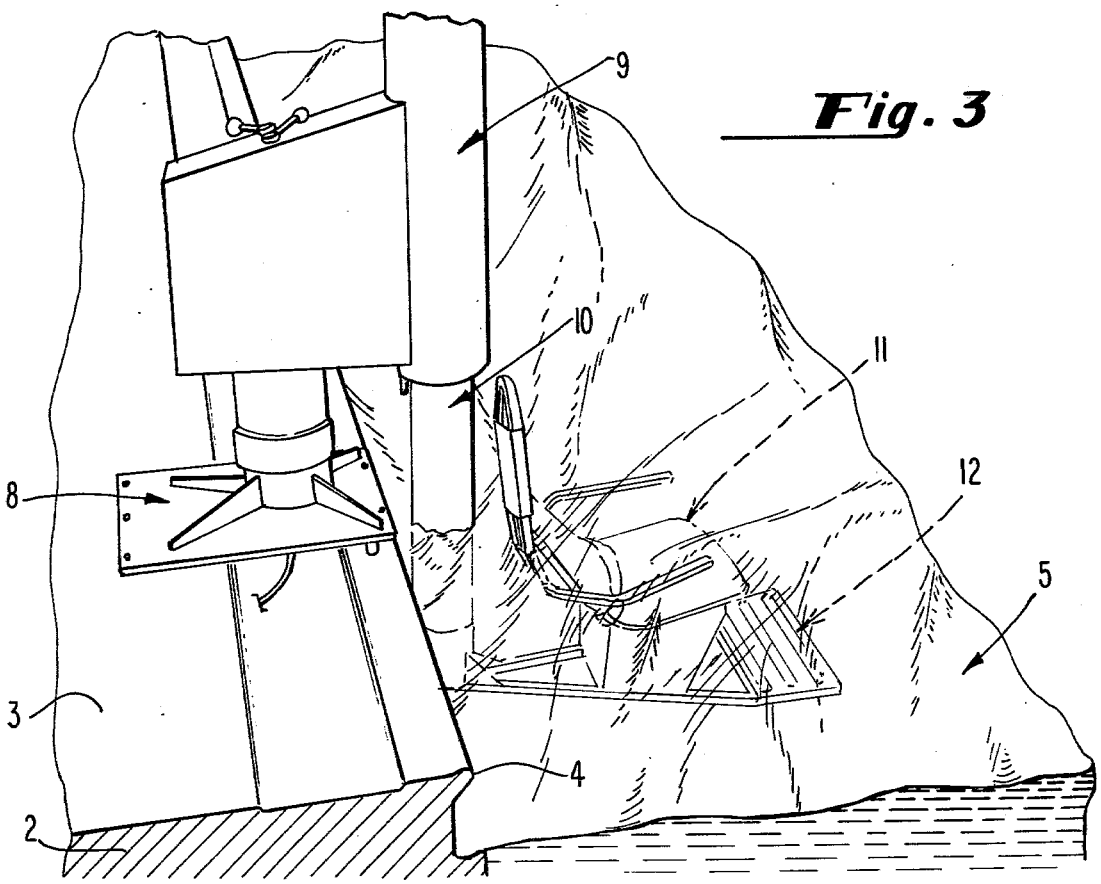
FIG. 3 is a perspective view illustrating the chair lowered into the water.

From the position of the FIG. 1, the lift means 11 is operated to raise the chair means 12 off the surface 3 (about 8") to an outboard position. This position lies in a horizontal transfer zone (see FIG. 1A). When in the transfer zone, the frame 9 can be rotated to swing the lift means 11 and chair means 12 out to the outboard position as shown in FIG. 2. The frame 11 and chair means 12 extend generally normal to the edge 4 of the pool. The chair means 12 is now ready for lowering in the water. The lift is operated to move chair means 12 down into the water as shown in FIG. 3. The degree of submersion may very according to the needs of the occupant. Thus the chair is appropriately positioned within a water zone which extends a vertical distance of approximately 36".

The chair means 12 is moved back to the load/unload position of FIG. 1 by operating the lift means to lift the chair means to the outboard position and then operating the frame 9 to swing the chair 12 in the transfer plane to the inboard position then lowering the lift 10 so that the chair frame 11 is firm against the top surface 3 and the chair means 12 is in the load/unload position.

As noted in FIG. 1, the chair means 12 is provided with a pair of arms 14*a* and 14*b*, safety belt 15, a seat 16, back 17 having head rest 18. The chair frame 11 carries a foot platform 19. The arm 14*a* is pivotally mounted so that it can be rotated between the up position as shown in FIG. 1 to the down position parallel with the arm 14*b* as shown in FIG. 2.

The chair means with the arm 14*a* is rotated to the vertical position as shown in FIG. 1 allows a handicapped person on supporting equipment such as a wheel chair or crutches to be seated in the chair virtually without assistance. For example, a person in a wheel chair rotates the arm to the up position and then by gripping the chair means with his hands can lift himself out of the wheel chair and on to the seat 16. After being seated the occupant rotates the arm 14*a* down.

The safety belt 15 is the conventional type and after the arm 14*a* is rotated to the down position, the occupant can fasten himself in by manulipation of the safety belt.

The platform 19 may be provided with anti-skid strips 19*a*.

The above described movements of the apparatus are effected by an operator manipulating controls. Thus, after a handicapped person is seated in the chair as above described, the attendant or operator manipulates controls to move the apparatus into the position of FIG. 3, The handicapped person then can push or glide off in the water. This is done simply by unfastening the seat belt 15 and using the arms 14*a* and 14*b* as a base for pushing off.

When the swimming or therapy session is completed the person swims back to the chair and gets seated by moving the arm 14*a* upwardly, putting on the seat belt and then moving the arm back to the horizontal position. At that time the person is ready to be transferred back to the load/un-load position.

The structural details of the apparatus for accomplishing the above functions will now be described.

Figures 4, 5:
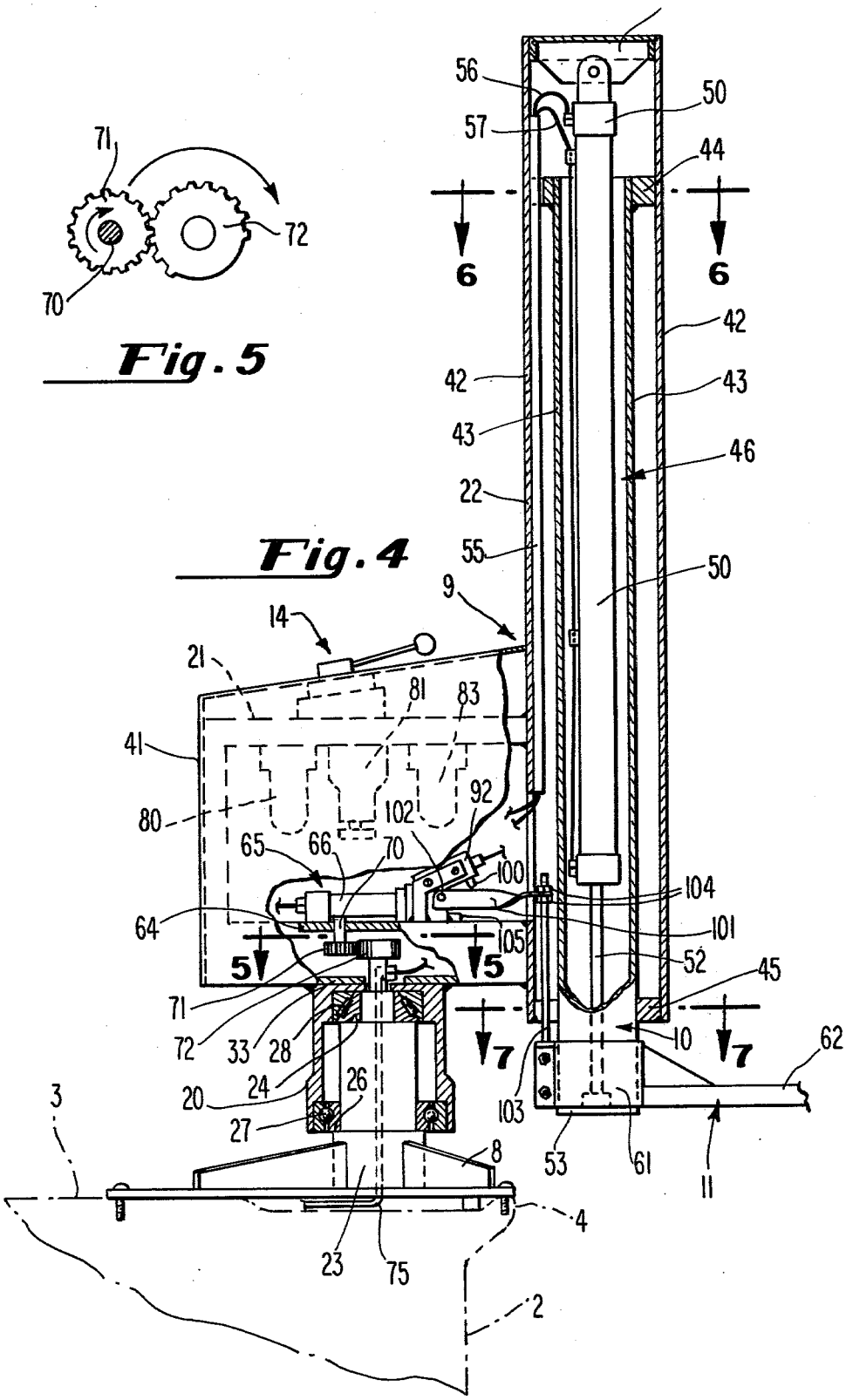
FIG. 4 is a sectional, elevational view of the apparatus of FIG. 1.
FIG. 5 is a view taken along the lines 5—5 of FIG. 4.

In FIG. 4 the base 8 is secured to the top surface 3 adjacent the edge 4 of the pool by a conventional bolt arrangement. The base supports the frame means 9 which comprises the bearing frame 20, the service frame 21 and the lift frame 22. The frame 9 and components parts mentioned are rotatably mounted on the base 8 as follows.

The base 8 fixedly mounts a bearing post 23 which extends vertically upwardly from the base. A top shoulder 24 on the post 23 carries tapered axial thrust bearings 25 and a lower shoulder 26 carries the radial bearings 27. The bearings 25 and 27 rotatably mount the bearing frame 20.

The bearing frame 20 mounts the service frame 21, the frames being rigidly welded together.

The service frame 21 is comprised of welded angled members, the general structure of which is illustrated in FIG. 8. A bottom section has angled members 30, 31 and 32. The angled members 31 and 32 carry cross plate 33 which is welded to the top of the bearing frame 20. The inner ends of the angled members 21 and 32 are welded to the lift frame 22. A top section has angled members 34 and 35 and 36, and a center section is comprised of angle members 40 and 41. The inner ends of the angles 35 and 36 are welded to the lift frame 22. The service frame 21 removably mounts the housing 41.

The lift frame means 22 includes the elongated cylinder 42, which as noted above, is fixedly welded to the service frame angles 31, 32, 35 and 36.

The lift frame means 10 includes the outer cylinder 43 which is slidably mounted within the lift frame inner cylinder 42 for reciprocating vertical motion as by the sliding bearings means 44 and 45.

The bearing means 44 is annular sleeve member which is welded to the top of the inner cylinder 43 in sliding contact with the inside surface of the outer cylinder 42 which effectively forms track means for the bearing.

The bearing means 45 is an annular sleeve member which is welded to the inside of the outer cylinder 42 in sliding contact with the outside of the inner cylinder 43 which effectively is a track means for the bearing.

The motor means for causing the reciprocation of the lift is a double acting piston/cylinder means 46. The cylinder 50 of the motor means 46 is pivotally supported on the top of the outer cylinder 42 as by the plate 51. The piston of the motor has a rod 52 which is fixed to the bottom of the inner cylinder 43 as by the plate 53.

Figure 6:
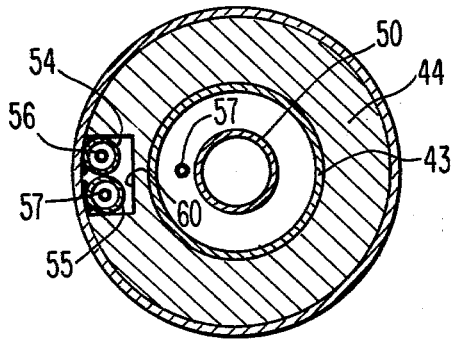
FIG. 6 is a view taken along the lines 6—6 of FIG. 4.
Figure 7:
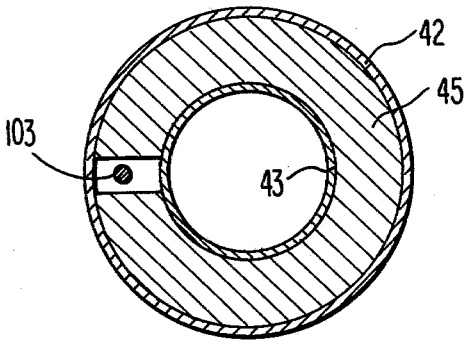
FIG. 7 is a view taken along the lines 7—7 of FIG. 4.

On the inside of the outer cylinder 42 are welded the tubes 54 and 55 which respectively carry air lines 56 and 57. The bearing 44 (FIG. 6) is slotted at 60 and makes a sliding engagement with the tubes 54 and 55. The tubes 54 and 55 act as a key and the slot 60 as a keyway operating to restrain the inner cylinder 43 against rotation. It will be apparent that a slot formed in the lower bearing 45 co-operating with the strips or tubes welded to the inner cylinder 43 can be provided for additional insurance against rotation or twisting of the inner cylinder 43.

The chair frame 11 includes a split collar 61 welded to the lower end of the inner cylinder 43. The collar mounts a pair of struts 62 and 63 extending radially outwardly from the cylinder 43. The struts carry the platform 17 and the chair means 12.

The mechanism for rotating the frame means 9 will next be described.

The members 31 and 32 of service frame 21 carry a support 64 which mounts motor means or rotary actuator 65. The motor means is a conventional device for converting linear motion of a piston into a rotary motion of a shaft. A typical device is a ROTO-CYL manufactured by Deltrol Fluid Products, Delwood, Ill. 60104. The device has an air cylinder 66 within which is a double acting piston. The piston is connected to a chain operating on sprockets at opposite ends of the cylinder. One of the sprockets is connected to an outwardly extending shaft 70. When the piston is moved in one direction, the shaft is caused to rotate in one direction and when the piston reverses the shaft reverses direction. The shaft carries pinion 71 (FIG. 5) meshing with pinion 72 fixed on the bearing post 23. It will be apparent that rotation of the pinion 71 will cause the same to orbit or rotate about the axis of the fixed pinion 72. This causes the frame means 9 to partake of the same motion.

The amount of rotation of the pinion 72 and frame means 9 is limited by the amount of piston travel and the gear ratio of pinions 71 and 72. In this case, the total travel is approximately 135° as between the inboard and outboard positions in the transfer zone.

The air system for operating the motor means 46 and 65 will next be described.

Referring to FIG. 9 an air source is indicated at 74. The source may be a permanently installed air compressor or a portable compressor which can be brought up to the apparatus and connected into the lines. As shown the source is a permanent type which feeds the air supply line 75.

The line 75 is connected to units which are conventional in air supply systems; namely the filter 80, the regulator 81 and the oiler 82. These units are mounted on the service frame 21 as indicated by the dotted lines in FIG. 4.

A rotate valve 83 and a lift valve 84 are also mounted on the service frame 21 just below the top of the control panel 13 of the housing 41. The valves carry hand actuators 85 and 86. The rotate valve 83 supplies air to the actuator 65 and the lift valve 84 supplies air to the lift motor 46.

The lift valve 84 is fed by the line 90 from oiler 82. The discharge lines 56 and 57 are connected respectively to the top and bottom of the lift cylinder 50. As noted in FIGS. 4 and 6, the lines 56 and 57 run up thru the tubes 54 and 55. The lift valve handle 86 has a neutral position and operative positions on opposite sides. When the handle 86 is neutral both of the lines 56 and 57 go to exhaust. When the handle is turned to one side or the other the valve feeds lines 56 and 57 so that the piston in cylinder 50 goes down or up. The rate of movement is controlled by the rotary position of the handle.

The rotate valve 83 is fed by line 91 from the oiler, thru safety valve 92 and line 93. The discharge lines 94 and 95 supply the motor 65.

The rotate valve handle 85 also has a neutral position and operative positions on either side thereof. When the valve is in neutral, the lines 94 and 95 are connected to exhaust and when the handle is moved to one side or the other the air is fed to the actuator 65 to move the piston in the desired direction to rotate the frame 9 as between the inboard and outboard positions.

As mentioned above, the circuit has a safety feature which will permit rotation of the frame 9 only when the chair is in the transfer zone. This is accomplished as described following.

The safety valve 92 has an operating pin 100 which controls the operation. When the pin is "in", air can flow thru the valve and when the pin is "out" the valve cuts off flow. The pin position is determined by a lever 101. One end of the lever 101 is pivotally mounted on the support 64 by the pivot 102. The outer end of the lever 101 is connected to a rod 103 and by the nuts 104. As shown in FIG. 2, with the lift 10 maintaining the components in the transfer zone, the lower end of the rod engages the collar 61. In this position the lever 101 holds the pin 100 in the "in" position so that the air is free to flow thru the valve 92 and thence to the rotate valve 83.

When the lift is moved down the rod 103 follows the collar 61 and this causes the lever 96 to rotate down. The lever 101 moves until it contacts a stop 105 which is secured to the support 64. When the lever 101 contacts the stop 105, the pin 100 has moved to the "out" position and stops the flow of air. The amount of movement of the pin 100 necessary to actuate the valve 92 is very small so that only a slight down motion of the lift is necessary to prevent rotation.

We claim:

1. A swimming pool lift for handicapped persons, the lift being installed adjacent the edge of a swimming pool and comprising:

a base secured on the poolside surface adjacent the edge of the pool;

a bearing post fixed to the base and extending vertically upwardly therefrom;

bearing frame means surrounding said post;

axial bearing means supported on a shoulder adjacent one end of said post and connected to said bearing frame means;

radial bearing means supported on a shoulder spaced from said axial bearing means and connected to said bearing frame means;

service frame means fixedly connected to said bearing frame means;

lift frame means fixedly connected to said service frame means, said bearing frame means, said service frame means, and said lift frame means being rotatable in unison on said bearing means;

rotate motor means connected between said bearing post and said bearing frame means for causing said rotary motion;

lift means connected to said lift frame means for rotation therewith and for vertical reciprocating motion with respect thereto;

lift motor means connected between said lift frame means and said lift means for causing said reciprocating motion;

chair frame means fixedly connected to said lift means for rotation and for reciprocating motion therewith, the chair frame means extending radially outwardly of the axis of the reciprocation of the lift means;

chair means on said chair frame means, the chair means including a seat, a back and a pair of arms secured to the back means and extending above and over the seat, one of the arms being pivotally connected to the back whereby the arm can be swung upwardly away from the seat to provide open space for a person to enter the seat or to depart therefrom;

foot platform means on said chair frame means in front of and below said seat;

lift control mechanism connected to said lift motor means and being actuatable to cause the lift motor means to operate the lift means to vertically move the chair means into a horizontal transfer zone located at an elevation greater than that of the poolside surface and to vertically move the chair means out of the transfer zone;

rotate control mechanism connected to said rotate motor means and being actuatable to cause the rotate motor means to rotate said chair means when the chair means is in said transfer zone as between an inboard position and an outboard position, in the inboard position said chair means extending over and above the poolside surface and in the outboard position the chair means extending outwardly from the edge of the pool over and above the surface of the water;

said lift control mechanism being actuatable, when said chair means is in said inboard position, to cause the lift motor means to move said chair means vertically as between the inboard position and a load/unload position, in the latter position said chair means being engaged with the poolside surface in condition for a person to enter or leave; and said lift control mechanism being actuatable, when the chair means is in said outboard position, to cause said lift motor means to move said chair means vertically as between said outboard position and a position within a water zone wherein the chair means is submerged in the water to an extent permitting a person to enter or leave.

2. The lift of claim 1 further including safety means providing that said frame means is rotatable only when said chair means is in said transfer zone.

3. The lift of claim 1 wherein said rotate control mechanism includes means to determine the outboard and inboard positions.

4. The lift of claim 1 further including:

first sliding bearing means connected to said lift means adjacent the top thereof;

first track means on said lift frame means and having a sliding engagement with said first sliding bearing means;

second sliding bearing connected to lift frame means adjacent the bottom thereof; and second track means on said lift member and having a sliding engagement with said second sliding bearing means.

5. The lift of claim 4 wherein:

said lift motor means is a fluid piston and cylinder means;

said lift frame means includes an elongated frame cylinder and the cylinder of said lift motor means is connected adjacent the top of the frame cylinder and extends downwardly thru the frame cylinder;

said lift member includes an elongated lift cylinder disposed inside said frame cylinder generally coaxial therewith and connected to the piston of the lift motor means to be reciprocated thereby;

said first sliding bearing means is an annular sleeve bearing fixed to the outside of said lift cylinder and said first track means on said lift frame is formed by the inside surface of the frame cylinder; and said second sliding bearing means is an annular sleeve bearing fixed to the inside of said frame cylinder and said second track means is formed by the inside surface of said lift cylinder.

6. The lift of claim 2 wherein said second motor means is a fluid piston and cylinder means having a fluid supply line and said safety means comprises:

a valve mounted on said service frame and connected in said fluid supply line and conditionable to permit flow of fluid to said line and conditionable to stop flow of fluid to said line;

valve operating means connected between said valve and said lift means; and when said lift means positions said chair means is said transfer zone, said valve operating means conditioning said valve to pass fluid and when said lift means moves the chair means out of the transfer zone, the operating means conditioning said valve to stop the flow of fluid.

7. A swimming pool lift for handicapped persons, the lift being installed adjacent the edge of a swimming pool and comprising:

a base secured on the poolside surface adjacent the edge of the pool;

frame means rotatably mounted on said base;

rotate motor means connected between said base and said frame means to rotate the frame means relative to said base;

lift means connected to said frame means for rotation therewith and for vertical reciprocating motion with respect thereto;

lift motor means connected between said frame means and said lift means for causing said reciprocating motion;

chair frame means fixedly connected to said lift means for rotation and for reciprocating motion therewith, the chair frame means extending radially outwardly of the axis of the reciprocation of the lift means;

chair means on said chair frame means, the chair means including a seat, a back and a pair of arms secured to the back means and extending above and over the seat, one of the arms being pivotally connected to the back whereby the arm can be swung upwardly away from the seat to provide open space for a person to enter the seat or to depart therefrom;

foot platform means on said chair frame means in front of and below said seat;

lift control mechanism connected to said lift motor means and being actuatable to cause the lift motor means to operate the lift means to vertically move the chair means into a horizontal transfer zone located at an elevation greater than that of the poolside surface and to vertically move the chair means out of the transfer zone;

rotate control mechanism connected to said rotate motor means and being actuatable to cause the rotate motor means to rotate said chair means when the chair means is in said transfer zone as between an inboard position and an outboard position, in the inboard position said chair means extending over and above the poolside surface and in the outboard position the chair means extending outwardly from the edge of the pool over and above the surface of the water;

said lift control mechanism being actuatable, when said chair means is in said inboard position, to cause the lift motor means to move said chair means vertically as between the inboard position and a load/unload position, in the latter position said chair means being engaged with the poolside surface in condition for a person to enter or leave; and said lift control mechanism being actuatable, when the chair means is in said outboard position, to cause said lift motor means to move said chair means vertically as between said outboard position and a position within a water zone wherein the chair means is submerged in the water to an extent permitting a person to enter or leave.

8. The lift of claim 7 further including safety means providing that said frame means is rotatable only when said chair means is in said transfer zone.

9. A swimming pool lift for handicapped persons, the lift being installed adjacent the edge of a swimming pool and comprising:

base means secured on the poolside surface adjacent the edge of the pool;

frame means rotatably mounted on said base means;

rotate motor means connected between said base means and said frame means to rotate the frame means relative to said base means;

lift means connected to said frame means for rotation therewith and for vertical reciprocating motion with respect thereto;

lift motor means connected between said lift frame means and said lift means for causing said reciprocating motion;

chair means connected to said lift means for rotation and for reciprocating motion therewith, the chair means extending radially outwardly of the axis of the reciprocation of the lift means;

lift control mechanism connected to said lift motor means and being actuatable to cause the lift motor means to operate the lift means to vertically move the chair means into a horizontal transfer zone located at an elevation greater than that of the poolside surface and to vertically move the chair means out of the transfer zone;

rotate control mechanism connected to said rotate motor means and being acutatable to cause the rotate motor means to rotate said chair means when the chair means is in said transfer zone as between an inboard position and an outboard position, in the inboard position said chair means extending over and above the poolside surface and in the outboard position the chair means extending outwardly from the edge of the pool over and above the surface of the water;

said lift control mechanism being actuatable, when said chair means is in said inboard position, to cause the lift motor means to move said chair means vertically as between the inboard position and a load/unload position, in the latter position said chair means being engaged with the poolside surface in condition for a person to enter or leave; and said lift control mechanism being actuatable, when the chair means is in said outboard position, to cause said lift motor means to move said chair means vertically as between said outboard position and a position within a water zone wherein the chair means is submerged in the water to an extent permitting a person to enter or leave.

10. The lift of claim 9 further including safety means providing that said frame means is rotatable only when said chair means is in said transfer zone.

11. The lift of claim 9 wherein at least one of said arms is pivotally connected to said back whereby the arm can be swung upwardly away from the seat to provide open space for a person to enter the seat or depart therefrom.

12. The lift of claim 9 further including safety means providing that said frame means is rotatable only when said chair means is in said transfer zone and wherein at least one of said arms is pivotally connected to said back whereby the arm can be swung upwardly away from the seat to provide open space for a person to enter the seat or depart therefrom.

13. A swimming pool lift for handicapped persons, the lift being installed adjacent the edge of a swimming pool and comprising:

base means secured on the poolside surface adjacent the edge of the pool;

frame means rotatably mounted on said base means;

lift means connected to said frame means for rotation therewith and for vertical reciprocating motion with respect thereto;

lift motor means connected between said lift frame means and said lift means for causing said reciprocating motion;

chair means mounted on said lift means for rotation and for reciprocating motion therewith, the chair means extending radially outwardly of the axis of the reciprocation of the lift means;

lift control mechanism connected to said lift motor means and being acutatable to cause the lift motor means to operate the lift means to vertically move the chair means into a horizontal transfer zone located at an elevation greater than that of the poolside surface and to vertically move the chair means out of the transfer zone;

rotate control mechanism connected to said frame means and being actuatable to cause the frame means to rotate said chair means when the chair means is in said transfer zone as between an inboard position and an outboard position, in the inboard position said chair means extending over and above the poolside surface and in the outboard position the chair means extending outwardly from the edge of the pool over and above the surface of the water;

said lift control mechanism being actuatable, when said chair means is in said inboard position, to cause the lift motor means to move said chair means vertically as between the inboard position and a load/unload position, in the latter position said chair means being engaged with the poolside surface in condition for a person to enter or leave; and said lift control mechanism being actuatable, when the chair means is in said outboard position, to cause said lift motor means to move said chair means vertically as between said outboard position and a position wherein a water zone wherein the chair means is submerged in the water to an extent permitting a person to enter or leave.

14. The lift of claim 13 further including safety means providing that said frame means is rotatable only when said chair means is in said transfer zone.

15. A swimming pool lift for handicapped persons, the lift being installed adjacent the edge of a swimming pool and comprising:

base means secured on the poolside surface adjacent the edge of the pool;

frame means rotatably mounted on said base means;

lift means connected to said frame means for rotation therewith and for vertical reciprocating motion with respect thereto;

chair means mounted on said lift means for rotation and for reciprocating motion therewith, the chair means extending radially outwardly of the axis of the reciprocation of the lift means;

lift control mechanism actuatable to cause said lift means to vertically move the chair means into a horizontal transfer zone located at an elevation greater than that of the poolside surface and to vertically move the chair means out of the transfer zone;

rotate control mechanism actuatable to cause said frame means to rotate said chair means when the chair means is in said transfer zone as between said inboard position and an outboard position, in the inboard position said chair means extending over and above the poolside surface and in the outboard position the chair means extending outwardly from the edge of the pool over and above the surface of the water;

said lift control mechanism being actuatable, when said chair means is in said inboard position, to cause said lift means to move said chair means vertically as between the inboard position and a load/unload position, in the latter position said chair means being engaged with the poolside surface in condition for a person to enter or leave; and said lift control mechanism being actuatable, when the chair means is in said outboard position, to cause said lift means to move said chair means vertically as between said outboard position and a position within a water zone wherein the chair means is submerged in the water to an extent permitting a person to enter or leave.

* * * * *